US005286225A

United States Patent [19]

Tsuji

[11] Patent Number: 5,286,225

[45] Date of Patent: Feb. 15, 1994

[54] CONNECTOR HOUSING ASSEMBLY

[75] Inventor: Yoshitsugu Tsuji, Mie, Japan

[73] Assignee: Sumitomo Wiring Systems, Ltd., Mie, Japan

[21] Appl. No.: 708,600

[22] Filed: May 31, 1991

[30] Foreign Application Priority Data

Jun. 4, 1990 [JP] Japan ..... 2-58895[U]

[51] Int. Cl.[5] ..... H01R 13/514

[52] U.S. Cl. ..... 439/752; 439/717; 439/718

[58] Field of Search ..... 439/594, 595, 598, 752, 439/701, 708, 712, 717, 718

[56] References Cited

U.S. PATENT DOCUMENTS 4,046,452 9/1977 Cassarly .
4,368,939 1/1983 Foederer ..... 439/595 X
4,753,614 6/1988 Weiner ..... 439/717
4,944,695 7/1990 Tsuji et al. .

FOREIGN PATENT DOCUMENTS 2223171 9/1990 Japan .

*Primary Examiner*—Eugene F. Desmond

*Attorney, Agent, or Firm*—Sughrue, Mion, Zinn, Macpeak & Seas

[57] ABSTRACT

A connector housing assembly 2 comprises a plurality of housings 3 each having a series of laterally arranged terminal accommodating chambers 4 and combined and united in a plurality of layers with the longitudinal direction of the terminal accommodating chambers 4 being trued up. The assembly further has a terminal locking mechanism comprising locking ports 6 provided in one of adjacent housings 3 in such a manner as to be situated at the rear of the locking portions 8 of terminals 1; and locking projections 10 provided on the other housing 3 in such a manner as to project therefrom so that the locking projections 10 are inserted through the locking ports 6 to be brought into engagement with the locking portions 8 of terminals accommodated in the one of the adjacent housings 3. Furthermore, a case unit 12 is provided for securely covering and locking said housings in a combined and united posture. The plurality of housings are preferably of similar shape and size. A locking pawl 16 is preferably provided at the top end of the respective locking projections 10.

2 Claims, 3 Drawing Sheets

CONNECTOR HOUSING ASSEMBLY

BACKGROUND OF THE INVENTION

1. Field of the Invention

The present invention relates to a connector housing assembly for use for wiring harnesses or the like.

2. Statement of the Prior Art

A terminal locking mechanism is provided on a connector housing assembly for preventing terminals inserted and secured in the connector housing assembly from coming thereoff and there are two types of terminal locking mechanisms employed.

In one of the two terminal locking mechanisms, a locking piece construction is used in which locking pieces are integrally provided on a connector housing assembly via hinges so that the locking pieces are brought into engagement with the locking portions of terminals for prevention of the withdrawal of the terminals. In the other terminal locking mechanism, a spacer construction is used in which separate spacers are inserted into a connector housing assembly from the rear thereof and secured therein for prevention of the withdrawal of terminals.

Recently, as more and more electric equipments are used in an automotive vehicle, the number of circuits of a wiring harness for an automotive vehicle is increasing, and the number of circuits used sometimes reaches several hundreds. There is a great deal of difficulty from the standpoint of quality and operating efficiency in performing wiring harness fabricating and forming operations in which groups of electric wires required to meet that tremendous number of circuits are laid in certain configurations, and connectors are connected thereto. In order to deal with this difficulty, a single wiring harness is divided into groups each comprising several divided wiring harnesses, and these groups of divided wiring harnesses are then assembled and formed into one unit. Afterwards, half-type connector housings each accommodating terminals of intergroup-connecting electric wires drawn out of the respective divided wiring harnesses are combined with half-type connector housings of the divided wiring harnesses, which mate with the former half-type connector housings, to thereby form a single connector housing assembly. Thus, a connector housing assembly employing a combine-and-unite construction is now used in which divided wiring harnesses are connected to each other to be united into one wiring harness having a required number of circuits.

Of the above two terminal locking mechanisms having prior art means, the former locking piece construction requires the operation of the locking pieces in order to bring the same into engagement with terminals after the terminals have been inserted. In addition, there is a risk of thin and fragile hinge portions being damaged/-broken during the relevant operation. The latter spacer construction requires the preparation of separate spacers to be inserted into the connector housing from the rear thereof to be secured therein. Both of these constructions have a drawback in that they are not suitable as a connector for a wiring harness for an automotive vehicle that requires high operating efficiency.

In addition, since high operating efficiency is also inevitable even with the above connector housing assembly employing the combine-and-unite construction, as in the case of the above terminal locking piece construction, a connector housing assembly capable of further improving operating efficiency is still required.

SUMMARY OF THE INVENTION

An object of the present invention is to provide a connector housing assembly that can solve the drawback inherent in the prior art, and which can meet the technical requirements from the field to which the present invention pertains.

Another object of the present invention is to provide a connector housing assembly that is easy to be fabricated and reliable in operation.

A further object of the present invention is to provide a connector housing assembly in which the combination of a plurality of housings is effected in synchronism with the locking of terminals.

A connector housing assembly designed according to the present invention to solve the above-mentioned technical problem comprises a plurality of housings each having a series of laterally arranged terminal accommodating chambers and combined and united in a plurality of layers with the longitudinal direction of the terminal accommodating chambers being trued up, and has a terminal locking mechanism comprising locking ports provided in one of adjacent housings in such a manner as to be situated at the rear of the locking portions of terminals' and locking projections provided on the other housing in such a manner as to project therefrom so that the locking projections are inserted through the locking ports to be brought into engagement with the locking portions of terminals accommodated in the one of the adjacent housings.

Furthermore, the connector housing assembly according to the present invention employs a construction in which a case unit is placed over the plurality of housings to securely cover the same, or a locking pawl is provided on the top end of the locking projection to thereby retaining the plurality of housings in a combined and united posture.

In an embodiment of the above connector housing assembly, a plurality of housings of similar shape and size are sometimes combined and united into one connector housing assembly.

Since the connector housing assembly of the present invention combined and united as described above has a terminal locking mechanism for connecting vertically adjacent housings together in which, for instance, locking projections provided on a lower housing in such a manner as to project therefrom are brought into engagement with the rear of the locking portions of terminals accommodated in an upper housing, and since those locking projections are provided on the circumferential wall of the housing in such a manner as to project therefrom, the connector housing assembly can be solidly constructed, thereby allowing the connector housing assembly to function as a terminal locking mechanism for preventing the withdrawal of terminals, while providing remarkably high locking force.

Moreover, the locking projections function as a projection for positioning the plurality of combined and united housings, and when the terminal locking mechanisms are combined together, immediately the housings are combined and united together.

DETAILED DESCRIPTION OF THE PREFERRED EMBODIMENTS

Figure 1:
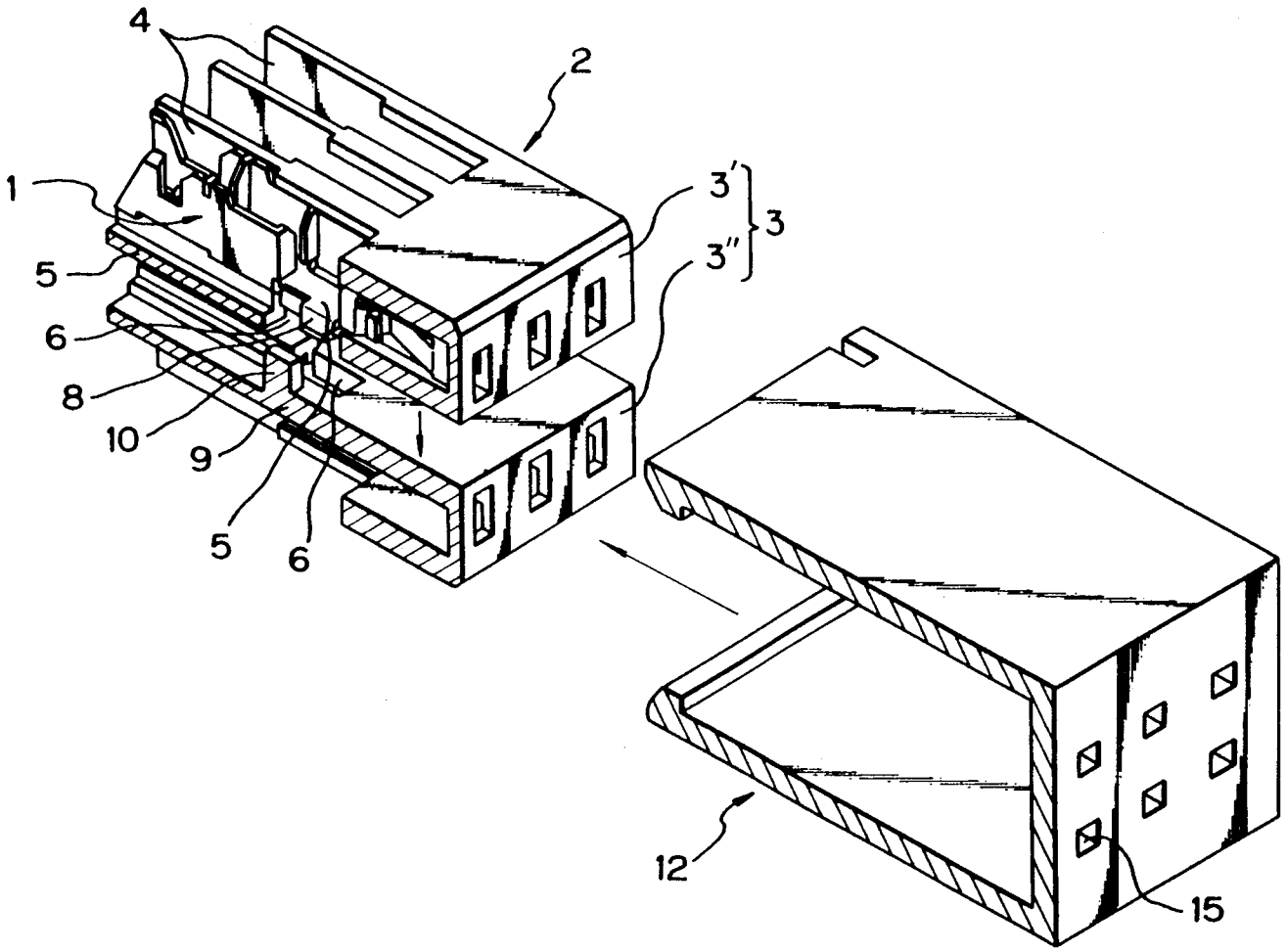
FIG. 1 is an exploded perspective view of a first embodiment of a connector housing assembly according to the present invention.
Figure 2:
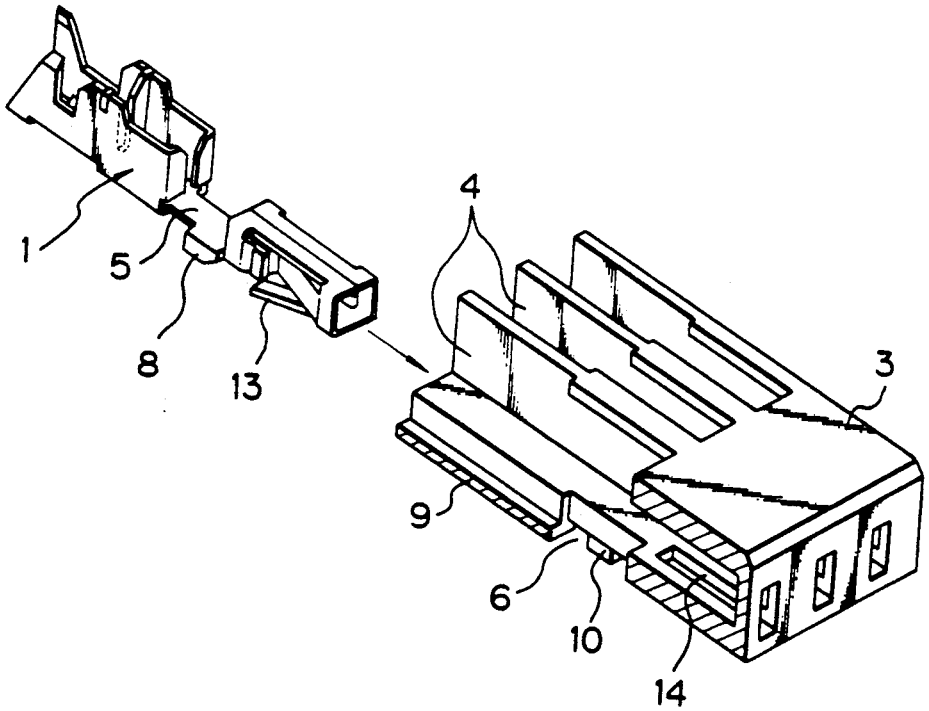
FIG. 2 is a perspective view of the housing shown in FIG. 1.

Referring to the drawings, embodiments of the present invention will be described in detail below. Shown first as a first embodiment in FIG. 1 is a connector housing assembly 2 for a wiring harness that accommodates pressure-welded terminals 1 (FIG. 2). This connector housing assembly 2 comprises two housings 3 of similar shape and size that are constructed in two layers. The housing 3 is formed into a flat shape in which a series of terminal accommodating chambers 4 are laterally arranged in parallel to each other. Locking ports 6 are formed in a circumferential wall 9 constituting the bottom of the respective terminal accommodating chambers 4 in such a manner as to penetrate therethrough, and these locking ports 6 are, respectively, situated at the rear of a plate-like locking portion 8 projecting sidewards at an intermediate position along the length of a bottom plate 5 of the pressure-welded terminal 1 when the terminal 1 is mounted in a proper posture.

A prism-like locking projection 10 is integrally provided on the circumferential wall 9 of the housing at positions adjacent to the respective locking ports 6 in such a manner as to project therefrom. When a pair of housings 3 are combined together in a back-to-back fashion with the longitudinal direction and longitudinal ends of the respective terminal accommodating chambers 4 being trued up, the locking projections 10 of a lower housing 3'' penetrate through the associated locking ports 6 of an upper housing 3' and are allowed to enter the associated terminal accommodating chambers 4 to be brought into abutment with the rear of the locking portions 8 of the pressure-welded terminals 1 accommodated in the respective terminal accommodating chambers 4, whereby the terminals are surely locked. A terminal locking mechanism is thus constituted.

In addition, there is provided a case unit 12 functioning as a bottomed cover unit for securely covering and accommodating therein an assembly comprising the pair of housings 3 that are combined back to back, and the combined and united posture of the connector housing assembly is fixed by securely covering the assembly with this cover unit 12, the combined and united housings being thus constructed so as to function as a single connector housing assembly.

As shown in FIG. 2 when the pressure-welded terminal 1 is inserted into the terminal accommodating chamber 4, a metal lance 13 on the terminal side fits into a locking slot 14 on the terminal accommodating chamber side to be secured therein, whereby the pressure-welded terminal 1 is primarily locked in its inserted posture. In addition, insertion holes 15 for associated terminals are formed in the bottom of the case unit 12.

Figure 3:
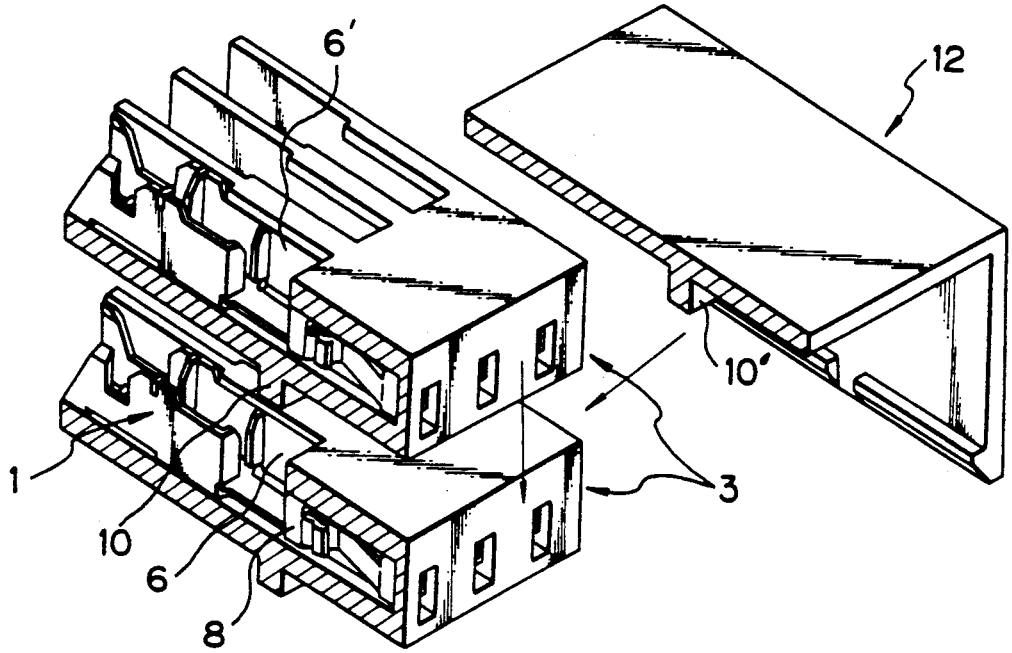
FIGS. 3 and 4 are exploded perspective views of other embodiments of the connector housing assembly according to the present invention.

Next, referring to FIGS. 3, 4, other embodiments of the present invention will be described. Connector housing assemblies shown, respectively, in FIGS. 3, 4 comprise a combination of housings 3 having locking projections 10 and locking ports 6 that are similar to those used in the embodiment shown in FIGS. 1, 2. The connector housing assembly shown in FIG. 3 comprises a pair of housings 3 of similar shape and size that are combined together in two layers in parallel with the vertical and longitudinal directions thereof being trued up. The cover unit 12 for securely covering the pair of housings 3 is formed into a shape in which it is provided with walls on two sides thereof with the bottom being left open. Locking projections 10' to be inserted into locking ports 6' of the upper housing 3 are provided on the inner side of a top wall so as to complement the locking projections 10 on the upper housing 3.

Figure 4:
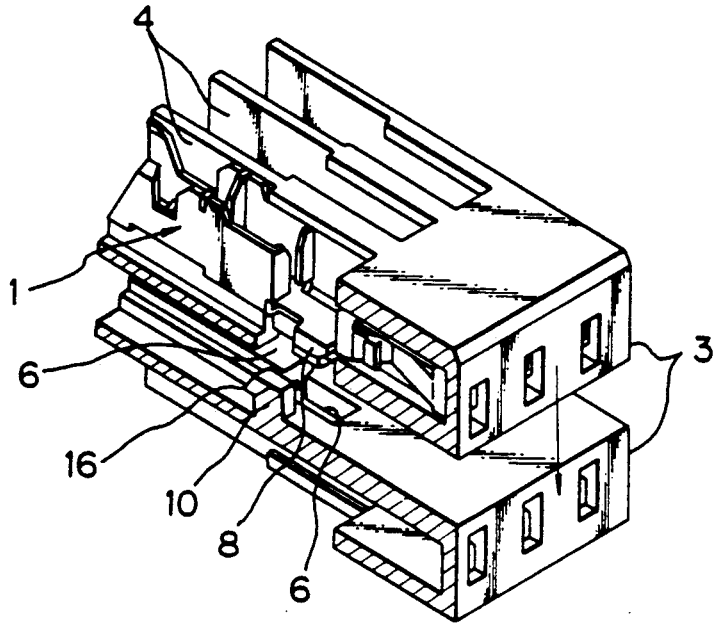

Furthermore, in the embodiment shown in FIG. 4, housings 3 similar to those used in the embodiment shown in FIG. 1 are used, and a locking pawl 16 is provided on the top end of the respective locking projection 10. This locking pawl 16 is then brought into mesh engagement with the edge portion of the respective locking ports 6 of the associated housing 3, the combined and connected posture of the housings 3 being thus secured.

As is described above, in the connector housing assembly according to the present invention, a plurality of housings are combined and united into a single connector assembly so as to improve its terminal locking performance, and the terminal locking function is automatically secured when the housings are combined and united together. Thus, since a superior combining performance is provided by the connector housing assembly of the present invention, the present invention is advantageous in that good operability is provided in uniting the connector housings into the connector housing assembly, and that the technical requirements from the field to which the present invention pertains are met.

Furthermore, the present invention is advantageous in that the mass production effects and the simplification of control is attained due to the unification of housings used when a plurality of housings of similar shape and size are combined together as in the case of the above embodiments.

What is claimed is:

1. A connector housing assembly comprising a plurality of housings each having a series of laterally arranged terminal accommodating chambers, for respectively accommodating terminals, and being combined and united in a plurality of layers with the longitudinal direction of said terminal accommodating chambers being trued up; and having a terminal locking mechanism comprising locking ports provided in one of adjacent housings in such a manner as to be situated at a rear of locking portions of the terminals, and locking projections provided on the other housing in such a manner as to project therefrom so that said locking projections are inserted through said locking ports to be brought into engagement with locking portions of the terminals accommodated in said one of adjacent housings, wherein a locking pawl is provided at a top end of each of said locking projections, so that said locking pawls are brought into mesh engagement with edge portions of locking ports of an associated housing, the posture of said plurality of housings combined and connected to each other being thereby secured, and wherein said connector housing assembly further comprises a case unit for securely covering and locking said housings in a combined and united posture, said case unit including a top wall, two side walls and an open bottom portion, said top wall including a plurality of locking projections for being inserted into locking ports of an uppermost housing, and each of said side walls including an inwardly projecting ridge for engaging with a lowermost housing.

2. An assembly as set forth in claim 1, wherein said assembly comprises a plurality of housings of similar shape and size.

* * * * *